US008011115B2

(12) United States Patent
Komulainen et al.

(10) Patent No.: US 8,011,115 B2
(45) Date of Patent: Sep. 6, 2011

(54) METHOD AND DEVICE IN A DRYER SECTION OF A FIBRE-WEB MACHINE, SUCH AS A PAPER OR BOARD MACHINE

(75) Inventors: Antti Komulainen, Keuruu (FI); Kari Juppi, Palokka (FI); Pasi Kekko, Toivakka (FI); Markku Lummila, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 665 days.

(21) Appl. No.: 12/162,503

(22) PCT Filed: Jan. 25, 2007

(86) PCT No.: PCT/FI2007/050039

§ 371 (c)(1),
(2), (4) Date: Aug. 12, 2008

(87) PCT Pub. No.: WO2007/085699

PCT Pub. Date: Aug. 2, 2007

(65) Prior Publication Data

US 2009/0019723 A1 Jan. 22, 2009

(30) Foreign Application Priority Data

Jan. 30, 2006 (FI) ..... 20065060

(51) Int. Cl.
*F26B 11/02* (2006.01)

(52) U.S. Cl. ..... 34/444; 34/117; 34/119; 427/316; 131/365; 442/59; 162/358.1; 162/267

(58) Field of Classification Search ..... 34/397, 34/413, 197, 444, 124, 117, 119; 162/358.1, 162/267; 442/43, 59; 131/365; 427/316
See application file for complete search history.

(56) References Cited

U.S. PATENT DOCUMENTS 2,911,040 A * 11/1959 Hornbostel ..... 162/305
(Continued)

FOREIGN PATENT DOCUMENTS

DE 3411752 A1 * 10/1984
(Continued)

OTHER PUBLICATIONS

Preliminary Report on Patentability issued in PCT/FI2007/050039, Apr. 2007.

(Continued)

*Primary Examiner* — Stephen Gravini
(74) *Attorney, Agent, or Firm* — Stiennon & Stiennon

(57) ABSTRACT

A fiber-web machine dryer section has a drying group with single-wire draw so the drying wire (F) presses the web (W) against heated cylinder surfaces with the web (W) at the side of the outside curve of reversing cylinders (11) situated between drying cylinders (10, 12). A pocket space (T) is formed between two adjacent drying cylinders (10) and a reversing cylinder (11) situated between them, and the drying wire (F). A negative pressure component (20) placed in the pocket space (T) creates a pressure difference over the drying wire (F) and the web (W) for attaching the web (W) to the drying wire (F) so the cross-direction shrinkage of the web (W) is controllable. The wire tension (F) is maintained at a level help control cross-direction shrinkage of the web. The pocket space (T) is sealed by sealing members (25, 26) to maintain negative pressure in the pocket space.

15 Claims, 4 Drawing Sheets

U.S. PATENT DOCUMENTS 3,445,938 A * 5/1969 Clark ..... 34/116
3,555,700 A * 1/1971 Wagner ..... 34/116
4,064,637 A * 12/1977 Lindgren ..... 34/122
4,113,557 A * 9/1978 Kankaanpaa ..... 162/301
4,192,713 A * 3/1980 Valkama ..... 162/358.1
4,236,962 A * 12/1980 Kankaanpaa ..... 162/204
4,359,827 A * 11/1982 Thomas ..... 34/452
4,359,828 A * 11/1982 Thomas ..... 34/114
4,441,263 A * 4/1984 Vedenpaa ..... 34/115
4,481,723 A * 11/1984 Vedenpaa ..... 34/114
4,483,745 A * 11/1984 Wicks et al. ..... 162/205
4,526,655 A * 7/1985 Karvinen et al. ..... 162/360.2
4,556,450 A * 12/1985 Chuang et al. ..... 162/204
4,561,939 A * 12/1985 Justus ..... 162/358.3
4,586,984 A * 5/1986 Laapotti ..... 162/358.3
4,625,430 A * 12/1986 Aula et al. ..... 34/392
4,669,198 A * 6/1987 Wedel ..... 34/456
4,807,371 A * 2/1989 Wedel ..... 34/117
4,876,803 A 10/1989 Wedel
4,888,883 A 12/1989 Kerttula
4,905,380 A * 3/1990 Eskelinen et al. ..... 34/457
4,921,575 A * 5/1990 Page ..... 162/306
4,931,143 A * 6/1990 Karvinen et al. ..... 162/360.2
4,934,067 A * 6/1990 Wedel ..... 34/457
4,976,821 A * 12/1990 Laapotti ..... 162/360.2
4,988,410 A * 1/1991 Meinecke et al. ..... 162/360.2
5,020,242 A * 6/1991 Mayer et al. ..... 34/115
5,022,163 A * 6/1991 Ilvespaa et al. ..... 34/458
5,023,985 A * 6/1991 Salo et al. ..... 492/53
5,044,094 A 9/1991 Ilvespää et al.
5,063,689 A 11/1991 Sollinger
5,065,529 A * 11/1991 Skaugen et al. ..... 34/117
5,135,614 A 8/1992 Aula et al.
5,144,758 A * 9/1992 Skaugen et al. ..... 34/117
5,163,236 A * 11/1992 Heikkila ..... 34/115
5,175,945 A * 1/1993 Skaugen et al. ..... 34/117
5,214,861 A * 6/1993 Vuorinen ..... 34/114
5,241,761 A * 9/1993 Hauser ..... 34/117
5,249,372 A * 10/1993 Wedel ..... 34/117
5,279,049 A 1/1994 Skaugen et al.
5,341,579 A * 8/1994 Schiel et al. ..... 34/115
5,388,347 A 2/1995 Kerttula et al.
5,389,205 A * 2/1995 Pajula et al. ..... 162/205
5,397,438 A * 3/1995 Nyberg et al. ..... 162/207
5,404,653 A * 4/1995 Skaugen et al. ..... 34/117
5,416,980 A * 5/1995 Ilvespaa ..... 34/117
5,477,624 A * 12/1995 Haessner et al. ..... 34/117
5,495,678 A * 3/1996 Ilmarinen et al. ..... 34/117
5,515,619 A * 5/1996 Kahl et al. ..... 34/114
5,517,765 A * 5/1996 Christansen ..... 34/116
5,526,579 A 6/1996 Kade et al.
5,535,527 A * 7/1996 Virta et al. ..... 34/117
5,553,392 A * 9/1996 Hanaya ..... 34/115
5,586,397 A * 12/1996 Kerttula et al. ..... 34/114
5,600,898 A * 2/1997 Deshpande et al. ..... 34/116
5,628,124 A * 5/1997 Skaugen et al. ..... 34/117
5,647,141 A * 7/1997 Hanaya ..... 34/115
5,653,041 A * 8/1997 Ilmarinen et al. ..... 34/117
5,662,778 A * 9/1997 Laapotti ..... 162/360.2
5,756,156 A * 5/1998 Elijoki et al. ..... 427/316
5,762,761 A * 6/1998 Kivimaa et al. ..... 162/360.2
5,775,001 A * 7/1998 Kerttula et al. ..... 34/114
5,782,009 A * 7/1998 Kotitschke ..... 34/117
5,832,625 A * 11/1998 Skaugen et al. ..... 34/117
5,862,613 A * 1/1999 Kerttula et al. ..... 34/446
5,864,965 A * 2/1999 Hansson et al. ..... 34/446
5,868,904 A * 2/1999 Laapotti ..... 162/360.3
5,888,354 A * 3/1999 Laapotti ..... 162/359.1
5,908,536 A * 6/1999 Kaasalainen et al. ..... 162/205
5,933,977 A * 8/1999 Deshpande et al. ..... 34/116
5,933,979 A * 8/1999 Wedel ..... 34/446
5,933,980 A * 8/1999 Deshpande et al. ..... 34/446
5,951,821 A * 9/1999 Laapotti ..... 162/205
5,987,774 A * 11/1999 Moskowitz ..... 34/117
6,001,421 A * 12/1999 Ahonen et al. ..... 427/316
6,003,245 A * 12/1999 Lipponen et al. ..... 34/457
6,103,066 A * 8/2000 Laapotti ..... 162/193
6,105,277 A * 8/2000 Lindberg et al. ..... 34/456
6,128,833 A * 10/2000 Juppi et al. ..... 34/464
6,219,934 B1 * 4/2001 Moskowitz ..... 34/117
6,317,999 B1 * 11/2001 Virta et al. ..... 34/114
6,365,004 B1 * 4/2002 Hamstrom et al. ..... 162/198
6,418,639 B1 * 7/2002 Virta et al. ..... 34/455
6,574,884 B1 * 6/2003 Jokinen ..... 34/114
6,662,468 B2 * 12/2003 Juppi et al. ..... 34/454
6,694,639 B2 * 2/2004 Hanaya ..... 34/115
6,701,637 B2 * 3/2004 Lindsay et al. ..... 34/71
6,740,204 B2 * 5/2004 Kahl et al. ..... 162/363
6,910,282 B1 * 6/2005 Jokinen et al. ..... 34/444
7,036,242 B2 * 5/2006 Komulainen et al. ..... 34/117
7,172,982 B2 * 2/2007 Jaglowski et al. ..... 442/76
7,422,662 B2 * 9/2008 Leimu et al. ..... 162/374
7,510,631 B2 * 3/2009 Scherb et al. ..... 162/358.1
7,628,891 B2 * 12/2009 Gronych et al. ..... 162/359.1
2002/0124429 A1 * 9/2002 Straley et al. ..... 34/119
2002/0152630 A1 * 10/2002 Lindsay et al. ..... 34/111
2003/0019125 A1 * 1/2003 Hanaya ..... 34/114
2006/0085999 A1 * 4/2006 Scherb et al. ..... 34/453
2007/0172433 A1 7/2007 Roveri
2009/0019723 A1 * 1/2009 Komulainen et al. ..... 34/446
2009/0025249 A1 * 1/2009 Juppi et al. ..... 34/444

FOREIGN PATENT DOCUMENTS

DE 3538623 A1 * 5/1986
DE 4012421 A1 * 10/1991
DE 19742787 A1 * 4/1999
DE 19817202 A1 * 10/1999
EP 447385 A1 * 9/1991
EP 640716 A2 * 3/1995
EP 999305 A2 * 5/2000
EP 1193343 A2 * 4/2002
FI 83441 B 3/1991
JP 04222291 A * 8/1992
JP 06146190 A * 5/1994
JP 06294090 A * 10/1994
WO 98/48109 A1 10/1998
WO 99/23297 A1 5/1999
WO 2007/085699 A1 1/2007
WO 2007/085698 A1 8/2007
WO WO 2009083636 A1 * 7/2009

OTHER PUBLICATIONS

Search Report issued in PCT/FI2007/050039, May 2009.
Search Report issued in Fl 20065060, Nov. 2006.

* cited by examiner

METHOD AND DEVICE IN A DRYER SECTION OF A FIBRE-WEB MACHINE, SUCH AS A PAPER OR BOARD MACHINE

CROSS REFERENCES TO RELATED APPLICATIONS

This application is a U.S. national stage application of International App. No. PCT/FI2007/050039, filed Jan. 25, 2007, the disclosure of which is incorporated by reference herein, and claims priority on Finnish App. No. 20065060, filed Jan. 30, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in a dryer section of a fiber-web machine and to a device in a dryer section of a fiber-web machine.

As known from the prior art, drying groups of dryer sections based on cylinder drying in fiber-web machines, such as paper or board machines, employ twin-wire draw and/or single-wire draw. In twin-wire draw, each group of drying cylinders comprises two wires, which press the web, one from above and the other one from below, against heated cylinder surfaces. In single-wire draw, each group of drying cylinders comprises only one drying wire on whose support the web runs through the entire group so that the drying wire presses the web against the heated cylinder surfaces of the drying cylinders and the web remains at the side of the outside curve of the reversing cylinders or rolls situated between the drying cylinders. Thus, in single-wire draw, the drying cylinders are arranged outside the wire loop, and the reversing cylinders or rolls are arranged inside the loop. In the following description, by the term 'reversing cylinder' is also meant a reversing roll alternatively placed in a corresponding position, and the terms 'reversing cylinder' and 'reversing roll' are used synonymously in this description. In the single-wire draw groups of dryer sections based on cylinder drying in fiber-web machines, a pocket space defined by a wire is formed between two adjacent drying cylinders and a reversing cylinder situated between them in a lower row. In connection with the pocket space, we speak of 'opening' and 'closing nips', i.e. 'opening' and 'closing gaps', by which opening nip, or opening gap, is meant an area where the drying wire separates from the drying cylinder and, correspondingly, a closing nip, or a closing gap, is formed on the side of the pocket space when the wire runs to the reversing cylinder. In a similar manner, when the wire leaves the reversing cylinder, an opening nip, i.e. an opening gap, is formed on the outgoing side of the pocket space and, correspondingly, when the wire runs to the next drying cylinder, a closing nip, i.e. a closing gap, is formed between the drying wire and the drying cylinder. Although in this description the invention is mainly described in connection with paper machines, the invention also encompasses embodiments associated with other fiber-web machines, such as, for example, board machines.

During the process of manufacturing a paper web, a shrinkage profile in the cross direction of the web is typically created in the web in paper machines known from the prior art, which shrinkage profile is not straight but, typically, shrinkage is greater in the edge areas of the web than in the middle.

The shrinkage in the edge areas is generally 6-10% and the shrinkage in the middle areas is about 1.5%. The shrinkage of the web also affects other properties of paper, such as roughness, thickness and curl. For these reasons, in the design and manufacture of paper and board machines it has been necessary to take into account the cross-direction non-straight shrinkage profile of the web, for example, it has been necessary to supply less stock from the headbox to the edges, which increases the costs of design and manufacture.

As known from the prior art, attempts have been made to solve the problems discussed above by increasing the negative pressure in suction rolls used as reversing rolls. In that case, however, the difference in shrinkage between the edge and middle areas may even increase. In addition, suction rolls provided with a device arrangement at both ends of the roll for producing a higher negative pressure in the end area than in the middle area of the roll have been used as reversing rolls. With respect to the prior art relating to this, reference can be made to U.S. Pat. No. 5,135,614.

U.S. Pat. No. 5,388,347 in turn discloses an arrangement in which, among other things, for the purpose of reducing cross-direction shrinkage, the drying cylinders in connection with transfers over gaps between the groups in a dryer section of a paper machine are arranged close to each other.

With respect to the prior art, reference can also be made to U.S. Pat. No. 5,279,049, which discloses a method for restrained drying of a paper web, wherein the web is carried on support of a fabric around a dryer of a dryer section and, after that, the web is wrapped around a portion of a guide device placed immediately downstream relative to the dryer so that shrinkage in the edge area of the web is minimized.

It is also known from the prior art to arrange runnability components in pocket spaces of dryer sections, for example, blow boxes, blow-suction boxes and suction boxes, which are commonly used for providing negative pressure areas in connection with the pocket space to enhance runnability and to affect the run of the web and the wire from a drying cylinder to a reversing roll and, similarly, from the reversing roll to the next drying cylinder. Some arrangements of this kind are described below.

On the other hand, with respect to the prior art, reference can also be made to U.S. Pat. No. 5,163,236 disclosing an arrangement for a dryer section of a paper or coating machine, wherein pocket spaces between drying cylinders are arranged to be enclosed pocket chambers, the spaces between the cylinders being closed by a wall which is provided at both edges with sealing parts, preferably adjustable sealing parts, placed at a small distance from a wire.

With respect to the prior art, reference is further made to U.S. Pat. No. 4,905,380, in which ejection blows are arranged by means of a blow box placed in a pocket space of a drying group in order to produce a negative pressure field in gap spaces between the blow box and a wire on the run of the wire from a drying cylinder to a reversing roll and, correspondingly, from the reversing roll to a drying cylinder.

In addition, with respect to the prior art, reference is made to U.S. Pat. No. 4,876,803 disclosing a seal arrangement for reducing flows of air into a pocket space between two adjacent dryers in a dryer section, and a blow box arranged in the pocket space, and in which connection a reversing roll provided with an internal negative pressure source is used.

SUMMARY OF THE INVENTION

An object of the invention is to provide a method and a device in a dryer section of a fiber-web machine, such as a paper or board machine, in which attempts have been made to at least partly eliminate and/or minimize the problems described above in connection with the prior art, in particular in connection with cross-direction shrinkage of a web.

In accordance with the invention, means for controlling the cross-direction shrinkage of a web are arranged in connection with a pocket space of a dryer section applying single-wire draw in a fiber-web machine, such as a paper or board machine. In accordance with the invention, the web that is being dried is held in contact with a drying fabric, such as a drying wire, so that the pressure difference over the web is sufficiently high from the viewpoint of the cylinder/reversing roll dimensioning used and their position with respect to one another as well as from the viewpoint of the tension of the wire. A pressure difference over the web is produced by arranging a high negative pressure of 500-5000 Pa, most appropriately 1000-2500 Pa, in the pocket space, which negative pressure is also affected by the stock used, the dry solids and basis weight of the web, and running speed, so that a high speed, low dry solids at the beginning of drying or, in particular, a high basis weight of board require the highest negative pressure, as high as 5000 Pa. The inventors have realized the possibility of applying runnability components known in themselves in a new manner as negative pressure components used in connection with a pocket space in a dryer section for the purpose of controlling the cross-direction shrinkage of the web. In accordance with the invention, to control the cross-direction shrinkage of the web, a pressure difference is arranged over the web for holding the web in contact with a drying fabric, whereby its cross-direction shrinkage can be controlled. The pressure difference is produced by providing the pocket space with a negative pressure using a negative pressure component, and by sealing the pocket space between adjacent drying cylinders in the upper part of the pocket space by arranging members in connection with the upper sealing of the pocket space for sealing the gaps between it and the adjacent drying cylinders, and by arranging the transfer of the web from the drying cylinder to the reversing cylinder to be short. In addition, the tension of the wire is maintained at a level that is at least 3 kN/m, advantageously at least 4 kN/m. The length of the transfer between the drying cylinder and the reversing roll at the most 1000 mm, advantageously at the most 500 mm, determined based on the points of contact of the common tangent while the machine is at a standstill and the possible negative pressure effects have been turned off.

Besides shrinkage prevention, the negative pressure used/required is affected by the taking into account of the bending of the wire by means of wire tension. The wire bends from the cylinder towards the pocket when the negative pressure in the pocket space is increased, with the result that the point of separation of the wire and, correspondingly, the point of contact of the wire on the next cylinder (in this application, we speak of these terms as points of separation) are displaced upwards on the cylinder towards the upper sealing of the pocket space, thus impairing the efficiency of drying when the web wraps a shorter distance around the circumference of the cylinder. In this description, by the displacement of the point of separation of the wire is meant the displacement of the line of separation in the middle area of the web. In addition, the displacement of the point of separation depends on the tension profile of the wire, the tension being usually smaller in the middle, so that the displacement of the point of separation forms a displacement line whose maximum displacement is less than 200 mm, advantageously less than 60 mm. In the case of a 200 mm displacement, on a cylinder having a diameter of 1830 mm the contact (wrap) of the web with the cylinder, important from the viewpoint of drying, is reduced by 400 mm from the normal drying length of about 3740 mm, which is about 10.7% less, which means that 3 more cylinders would be needed for a dryer section of 30 cylinders and, correspondingly, in the case of a 60 mm displacement considered to be good, one additional cylinder would be enough as compared with the situation without a displacement. In practice, in at least part of the pocket space there is even today a negative pressure, but it is applied to problem areas and therefore comparison is difficult. For example, when the tension of the wire is 4 kN/m, and the negative pressure in the pocket 2 kPa and the displacement 60 mm, the distance between the rolls can be 10 mm or less with the geometry of the cylinder diameter of 1830 mm and the reversing roll diameter of 1500 mm.

The dependence of the maximum negative pressure (p) in the pocket space on the radius (R) of the cylinder and on the tension (T) of the wire can be expressed by the formula $p=T/R$, so that, for example, when the tension is 4 kPa and the radius of the drying cylinder is 0.915 m, 4.4 kPa is obtained as the theoretical maximum value of the negative pressure in the pocket space. In practice, the tension profile of the wire and the distance between the rolls shall also be taken into account, which reduces the maximum value, for example, to a value of 3.9 kPa. On the other hand, the formula also makes it possible to examine the tension of the wire and the negative pressure in the pocket $T=p\times R$, so that, for example, when the value of the negative pressure in the pocket is 2 kPa and the radius of the drying cylinder is 0.915 m, 1.83 kN/m is obtained as the theoretical minimum value of the wire tension. In practice, the tension profile of the wire and the distance between the rolls shall also be taken into account, which increases the minimum value, for example, to a value of 2.3 kN/m. When determining the length of the transfer between the drying cylinder and the reversing roll, the shorter said transfer, the larger will be the wrapping angle of the web on the drying cylinder and, thus, the higher the drying capacity. The point of separation of the web from the drying cylinder moves because of the bending of the wire so that it will be the earlier, the larger the distance between the rolls, the smaller the tension of the wire, and the larger the diameter of the drying cylinder. The measurements commonly used: a drying cylinder diameter of 1830 mm and a reversing roll diameter of 1500 mm, are regarded as the normal geometry in this application, although other embodiments are also disclosed in this application. For example, in a situation where the negative pressure in the pocket is 1 kPa, the tension of the wire is 4 kN/m and the distance between the rolls is 200 mm, the displacement of the point of separation is about 120 mm, which is still in a range of a reasonable displacement. On the other hand, when the negative pressure in the pocket is raised to 2 kPa and the distance between the rolls is reduced to 50 mm, it will be necessary to tighten the wire further to a value of 4.5 kN/m for a corresponding displacement and an advantageous range is reached only with a tension of about 7.5 kN/m.

In accordance with the invention, the reversing cylinders in the drying group applying single-wire draw in a dryer section of a fiber-web machine, such as a paper or board machine, are reversing cylinders or rolls of the type known in themselves in the state of the art, such as, suction rolls, without an internal suction box, of the type marketed by Metso Paper, Inc. under the trademark VacRoll, rolls which are provided with grooves and/or perforations and can have a suction box, and negative pressure can be produced solely by means of a negative pressure component in the pocket space, solely by means of a roll or by means of both of them. The negative pressure acting through the reversing roll or through its grooves and perforations or only through grooves or only through perforations is 500-5000 Pa, advantageously 1000-2500 Pa.

The geometry defined by cylinders, reversing rolls and the wire can be symmetric, where the reversing roll is in the center line between the cylinders at a selectable distance from the cylinders. In that case, the placement of the frames and the equipment is easy. On the other hand, the reversing roll can be placed closer to one cylinder, whereby a shorter transfer to the reversing roll makes it possible to control the separation of the web from the cylinder.

The method and device in accordance with the invention is applied in at least a portion of the dryer section, advantageously in an area of dry solids content of 65-90% in the longitudinal direction of the dryer section because the shrinkage of the web mainly occurs in this dry solids content range. Of course, the negative pressure in the pocket, the tension of the wire, and the geometry of the pocket can be adjusted in each drying group in the longitudinal direction of the machine so as to be suitable for the dry solids content range in question. In addition, the concept can be applied outside the dry solids content range, in which case the wire tensions, the negative pressures in the pocket space and the geometry used can be optimized based on runnability.

In accordance with the invention, a substantially straight shrinkage profile in the cross direction of the web is achieved in which shrinkage is advantageously at a level of 1-2% in the entire web.

In accordance with one advantageous additional feature of the invention, the gap between the negative pressure component and the reversing cylinder is also sealed with a sealing member, which is a mechanical or a blow seal, to stop the movement of the air flow carried with the reversing cylinder before it enters the gap closing on the reversing cylinder.

When applying the invention at high running speeds, the creation of boundary-layer air flows can be prevented, when needed, by means of doctors, which are most appropriately placed before the front side of the gap closing between the wire and the reversing roll.

In accordance with one advantageous additional feature of the invention, the reversing cylinder is arranged to be movable such that the distance of the reversing cylinder with respect to the drying cylinders can be adjusted and in such a way that the reversing cylinder can be arranged to avoid a damaged paper/wire portion of possibly several layers not able to pass through a minimum gap between the drying cylinder and the reversing cylinder, which gap is determined by the combined thickness of the wire and the web, being about 1-2 mm. This advantageous additional feature also makes it possible to move the reversing cylinder, for example, to a wire replacement position, for example, at a distance of 30 mm.

The arrangement in accordance with the invention is suitable for use in connection with drying groups applying single-wire draw in a dryer section of many different types of fiber-web machines. The structural alternatives of drying cylinders, reversing cylinders, negative pressure components and the drying fabric can be manifold, in themselves known by a person skilled in the art.

In the following, the invention will be described in more detail with reference to the figures in the appended drawing, but the invention is not meant, by any means, to be narrowly limited to the details of them.

DESCRIPTION OF THE PREFERRED EMBODIMENTS

Figure 1:
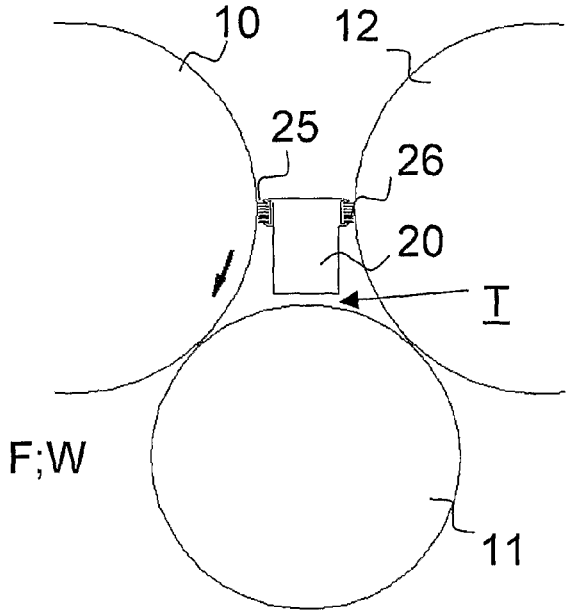
FIG. 1 schematically shows one embodiment of the invention.

FIG. 1 shows one embodiment of the arrangement in accordance with the invention, placed in a group of drying cylinders applying single-wire draw in a dryer section of a paper machine, which figure shows, of the drying group, adjacent drying cylinders 10 and 12, and a reversing cylinder/roll 11 placed below these in a staggered fashion. A paper web W that is being dried runs on support of a drying wire F from the drying cylinder 10 to the reversing cylinder 11 and further to the next drying cylinder 12 as a normal single-wire draw. A negative pressure component 20 is placed in a pocket space T remaining between the drying cylinder 10, the reversing cylinder 11 and the next drying cylinder 12 and the drying wire F, which negative pressure component is used for producing a strong negative pressure in the pocket space T to control the cross-direction shrinkage of the paper web W such that the attachment of the web W to the drying wire F is enhanced. Using the negative pressure component 20, a pressure difference over the web and the wire needed for the adherence of the web W is created by producing in the pocket space T a strong negative pressure area, which is confined by seals 25, 26 sealing the operating area of the negative pressure component 20 in the pocket space T to the surfaces of the drying cylinders 10 and 12. In the embodiment shown in the figure, the negative pressure component 20 is provided with mechanical seals 25, 26 but, when desired, it is possible to use a sealing arrangement accomplished by means of blows, in itself known from the state of the art. In addition, the pocket space is also sealed in the longitudinal direction of the machine in the end areas of the negative pressure component and, across the width of a possible threading zone, an additional sealing arrangement to ensure a negative pressure across the width of a leader strip in the threading process (not shown). It is important to apply/control the negative pressure in the cross direction across the width of the web in order to impart adherence to the entire web but not suck too much through the wire past the part covered by the web, so that the edges of the web can separate from the wire causing problems in shrinkage prevention and in runnability.

In the embodiment shown in FIG. 1, the pressure acting on the cylinder with a wire tension of 4 kN/m is about 4 kPa, which is a good value for preventing the cross-direction shrinkage of the web, the cylinder diameter being about 2 m. In that case, the negative pressure in the pocket space T is 3 kPa if the distance between the cylinder and the reversing roll is 15 mm at the most and the tension of the wire is the above-mentioned 4 kN/m. The negative pressure of the reversing roll for holding the web in contact with the wire corresponds to the negative pressure of the pocket space, i.e. 3 kPa.

In the arrangement of the invention, the distance from the drying cylinder 10 to the reversing cylinder 11 is short, preferably minimized according to the most demanding one of the fiber-web grades to be run, and this length of a common tangent between the points of contact is less than 1000 mm, most preferably 100-500 mm. By this is meant the theoretical path of the wire without a negative pressure in the negative pressure component and when the machine is at a standstill.

The negative pressure in the pocket produced by means of the negative pressure component 20 in accordance with the invention is 500-5000 Pa, advantageously 1000-2400 Pa depending on the diameter of the drying cylinder, for example, the diameter of the drying cylinder being 1850 mm and the diameter of the reversing roll being 1500 mm, as well as on the wire tension used, as appears from the following Table 1 showing the dependence of the negative pressure in the pocket, the size of the cylinder, and the tension of the wire on one another at a rough level. In the Table, the displacement of the gap opening from the cylinder caused by the bending of the wire has been adopted as a factor that limits the negative pressure in the pocket space.

TABLE 1

| Negative Pressure in the pocket (kPa) | Cylinder diameter (mm) | Theoretical wire tension |
|---|---|---|
| 3 | 1830 | 2.7 |
| 5 | 1830 | 4.6 |
| 3 | 3000 | 4.5 |
| 5 | 1000 | 2.5 |

Figure 2:
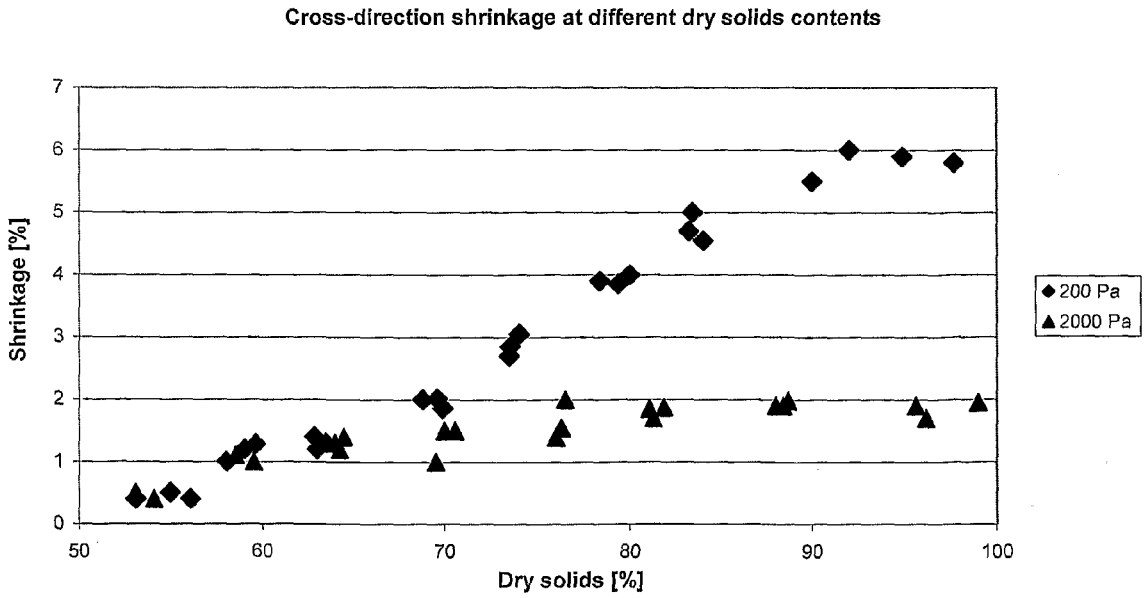
FIG. 2 schematically shows cross-direction shrinkage of paper attached to the wire by means of a pressure difference in accordance with one embodiment of the invention.

FIG. 2 shows cross-direction shrinkage of a paper web attached to the wire by means of a pressure difference. The horizontal axis represents the dry solids content of the web and the vertical axis represents the cross-direction shrinkage of the web. The negative pressure used is indicated in the figure by schematic marks (squares and triangles) and, as is clear from the figure, when the negative pressure is 2 kPa, it has been possible to prevent cross-direction shrinkage to a sufficient degree, i.e. to a level of about 1-2%.

Figure 3:
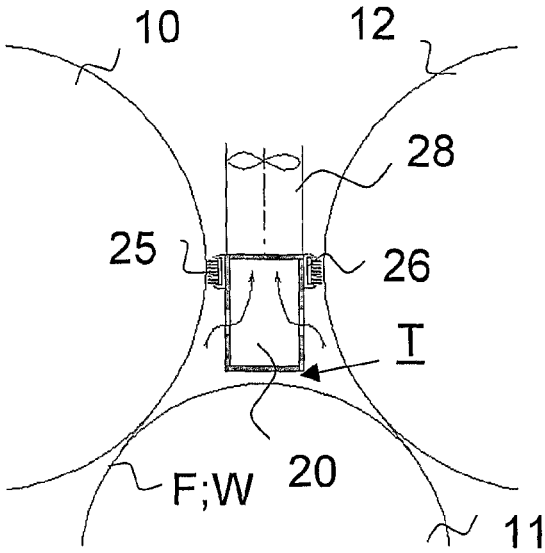
FIG. 3 schematically shows one embodiment of the invention, in which the reversing roll is a grooved roll.

FIG. 3 shows one embodiment of the invention, in which the reversing roll 11 is a grooved roll. This embodiment is suitable for use, for example, when threading imposes no limitations on the choice of the type of reversing roll. In the example of the figure, the negative pressure in the negative pressure component 20 is produced by means of an external negative pressure source 28. In other respects, the embodiment corresponds to that shown in FIG. 1. The distance of the seals 25, 26 from the wire F is maintained even though the negative pressure changes and the structures of the negative pressure component 20 bend because the bending occurs almost in the direction of the surfaces that are being sealed. The negative pressure in the reversing roll 11 can also be generated in other types of reversing roll, when desired, by means of the external negative pressure source 28.

Figure 4:
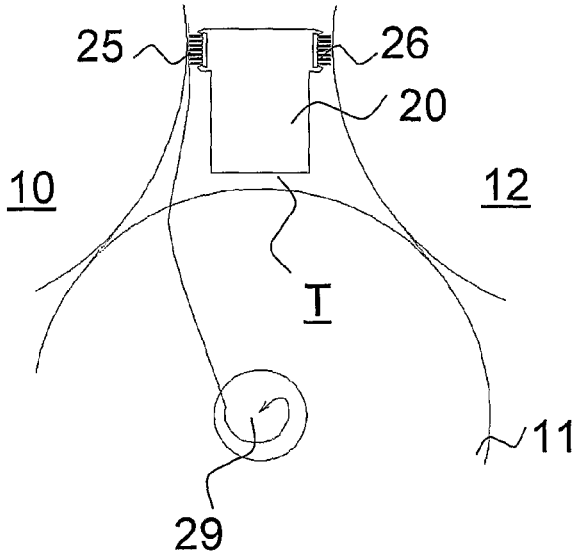
FIG. 4 schematically shows one embodiment of the invention, in which the reversing roll is a suction roll of the type marketed by Metso Paper, Inc. under the trademark VacRoll.

As shown in FIG. 4, when a suction roll of the type marketed by Metso Paper, Inc. under the trademark VacRoll is used as the reversing roll 11, it is possible to arrange the removal of air from the pocket space T by means of the reversing roll 11 through its shaft 29.

Figure 5:
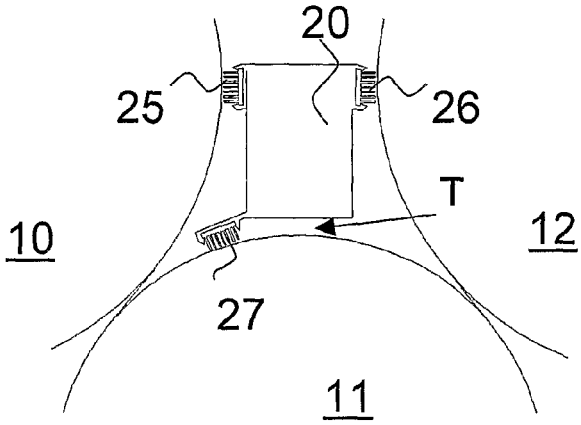
FIG. 5 schematically shows one embodiment of the invention, which is provided with an arrangement facilitating the threading of the web in accordance with one advantageous additional feature of the invention.

In the embodiment according to FIG. 5, a boundary-layer flow formed on the surface of the reversing roll 11 is prevented by means of a separate member 27, for example, by means of a sealing member 27 or a doctor placed against the surface of the reversing roll, and a corresponding member can also be placed on the descending run of the wire. The arrangement reduces the generation of positive pressure into the closing gap of the reversing roll at high speeds and at low negative pressures in the pocket.

In the arrangement in accordance with the invention, the running distance of the wire F and the web W from the drying cylinder 10 to the reversing cylinder 11 is minimized, which reduces the problems of the arrangements known from the state of the art because the bending of the wire does not reach the seals any more, with the result that the seals do not wear even at a high negative pressure. On the other hand, in the threading situation when the web is not sealing the wire, there is less leakage air in the short run between the cylinder and the reversing roll and, thus, a higher negative pressure in the pocket and more reliable threading are also achieved in the threading process.

Figure 6A:
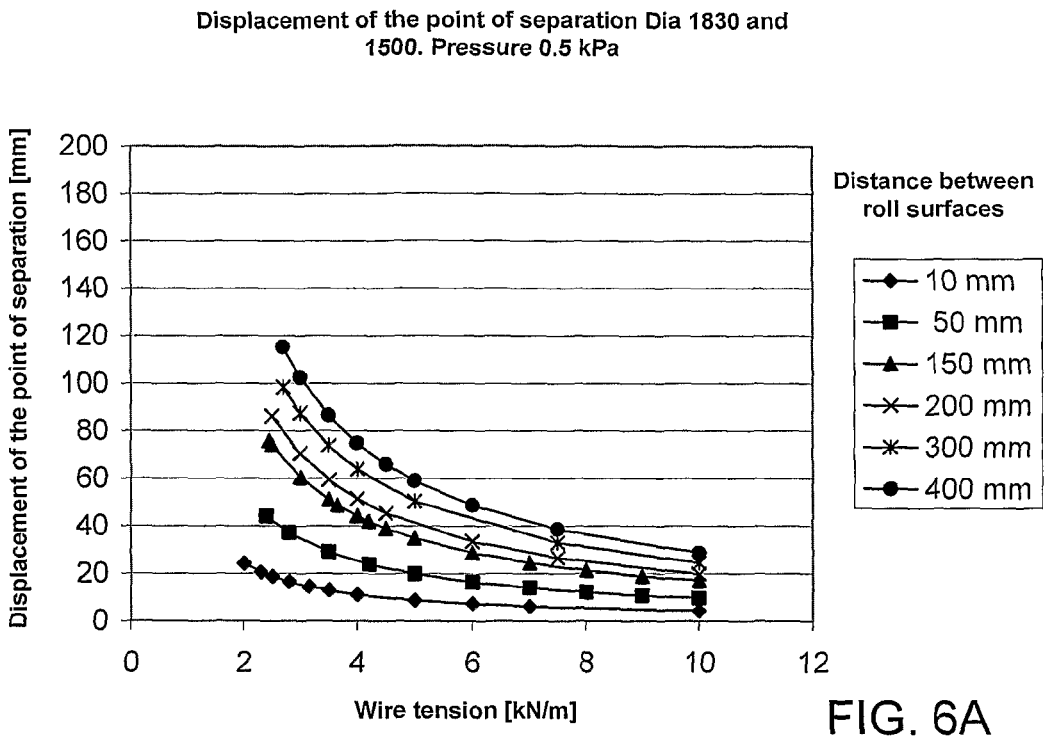
FIGS. 6A-6C schematically show examples of the displacement of the point of separation as a function of wire tension.
Figure 6B:
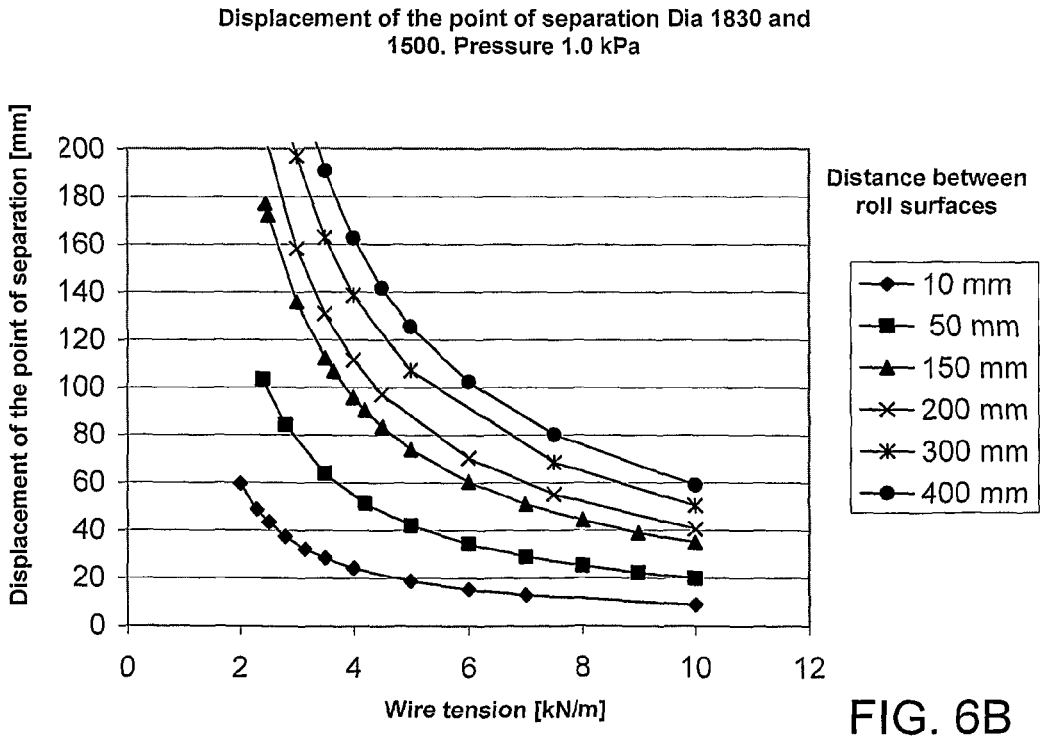
Figure 6C:
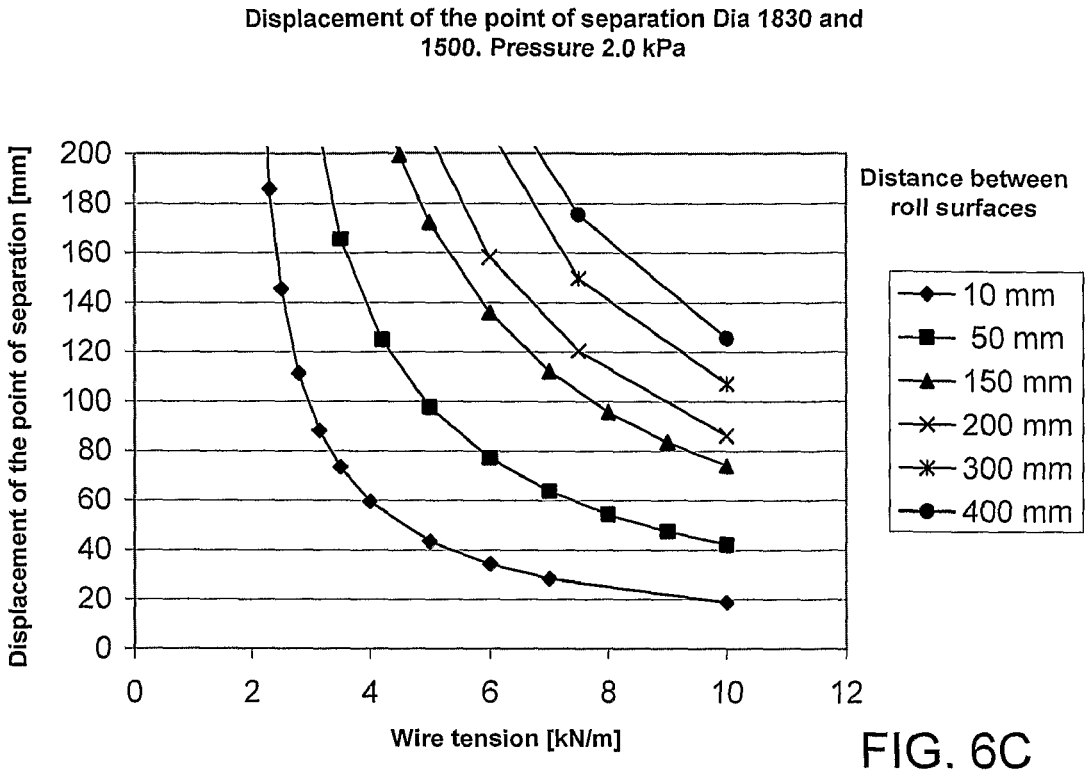

FIGS. 6A-6C schematically show the displacement of the point of separation as a function of wire tension. In the exemplifying calculations, the value of 1830 mm has been used as the diameter of the drying cylinder and the value of 1500 mm as the diameter of the reversing roll. In the example of FIG. 6A, the negative pressure in the pocket is 0.5 kPa, in the example of 6B it is 1.0 kPa and in the example of 6C it is 2 kPa. The figures show curves with different values of the distance between the surface of the drying cylinder and the surface of the reversing roll. As is clear from the figures, small wire tensions and high negative pressures in the pocket space cause a large displacement of the point of separation, and thus, a decrease in drying capacity, which can be remedied by reducing the distance between the roll surfaces, i.e. by shortening the transfer between the cylinder and the reversing roll. In practice, shrinkage prevention and runnability determine the negative pressure level needed in the pocket space, after which the displacement of the point of separation can be minimized by increasing wire tension and by bringing the roll surfaces closer to each other.

Above, the invention has been described only with reference to some of its advantageous exemplifying embodiments, but the invention is not by any means meant to be narrowly limited to the details of them.

The invention claimed is:

1. A method of drying a web in a dryer section of a paper or board machine comprising the steps of:

passing the paper web through at least one single-wire draw dryer group in which the paper web runs supported on a drying wire such that the drying wire presses the paper web against a heated cylinder surface of a first heated drying cylinder;

traversing the web from the first drying cylinder on an outside surface of the drying wire to a cylinder surface of a reversing roll along a first transfer length of less than 1000 mm, so the drying wire engages said reversing roll cylinder surface overlain by the paper web, and further transferring the web from the reversing roll to a second heated cylinder surface of a second drying cylinder along a second transfer length of less than 1000 mm and supported by the drying wire which presses the web onto the second heated cylinder surface, wherein the first drying cylinder, the second drying cylinder and the reversing roll positioned between the first drying cylinder and the second drying cylinder form together with the drying wire a pocket space therebetween;

enhancing the runnability of the web by using a negative pressure component placed in the pocket space to produce a negative pressure in the pocket space to create a negative pressure difference over the drying wire and the paper web for attaching the paper web to the drying wire such that the cross-direction shrinkage of the web is controlled;

maintaining a tension in the drying wire at a level of at least 3 kN/m to help to control the cross-direction shrinkage of the web; and sealing the pocket space with a first mechanical seal mounted to the negative pressure component extending towards the surface of the adjacent first drying cylinder and a second mechanical seal mounted to the negative pressure component extending towards the surface of the adjacent second drying cylinder to maintain the negative pressure in the pocket space.

2. The method of claim 1 wherein in the step of enhancing the runnability of the web by using the negative pressure component placed in the pocket space to produce the negative pressure in the pocket space, said negative pressure is created at least in part by the reversing roll.

3. The method of claim 1 wherein the step of producing a negative pressure in the pocket space includes the step of producing in the pocket space a negative pressure of at least 500 Pa.

4. The method of claim 1 wherein the step of producing a negative pressure in the pocket space includes the step of producing in the pocket space a negative pressure of at least 1000 Pa.

5. The method of claim 1 wherein the step of maintaining a tension in the drying wire comprises maintaining a tension in the drying wire at a level of at least 4 kN/m.

6. The method of claim 1 wherein the first transfer length is 100-500 mm.

7. The method of claim 1 wherein in the step of enhancing the runnability of the web by using the negative pressure component placed in the pocket space to produce the negative pressure in the pocket space, said negative pressure is created by an external negative pressure source.

8. The method of claim 1 further comprising removing air from the pocket space through the reversing roll.

9. A device in a paper or board machine, the device comprising:

a dryer section of the paper or board machine having at least one single-wire draw type drying group wherein a paper web is arranged to traverse a first heated cylinder surface of a first drying cylinder supported by a drying wire having a surface that presses the web onto the first heated cylinder surface, wherein the paper web on the drying wire extends from the first drying cylinder on the surface of the drying wire to a cylinder surface of a reversing roll along a first transfer of a length of less than 1000 mm, such that the drying wire engages said cylinder surface and is overlain by the paper web;

wherein the paper web extends from the reversing roll to a second heated cylinder surface of a second drying cylinder along a second transfer of a length of less than 1000 mm, the web supported by the drying wire and the drying wire arranged to overlie and to press the web onto the second heated cylinder surface;

wherein the first drying cylinder, the second drying cylinder and the reversing roll positioned between the first drying cylinder and the second drying cylinder, form together with the drying wire a pocket space therebetween;

a runnability component positioned in the pocket space, the runnability component positioned between the first heated drying cylinder, the reversing cylinder and the second heated drying cylinder, and the runnability component defining a negative pressure area between a first mechanical seal mounted to the runnability component and positioned against the first heated surface of the first drying cylinder and a second mechanical seal positioned against the second heated surface of the second drying cylinder so that the negative pressure area overlies the first transfer and the second transfer; and wherein the drying wire is arranged with a tension of at least 3 kN/m.

10. The device of claim 9 wherein the drying wire is arranged with a tension of at least 4 kN/m.

11. The device of claim 9 wherein the pocket space is connected to a source of negative pressure of at least 500 Pa.

12. The device of claim 11 wherein the pocket space is connected to a source of negative pressure of at least 1000 Pa.

13. The device of claim 1 wherein the first transfer is between 100-500 mm.

14. The device of claim 1 wherein the negative pressure component is provided with an external negative pressure source.

15. The device of claim 11 further comprising a sealing member mounted to the negative pressure component and placed against the surface of the reversing roll.

* * * * *

UNITED STATES PATENT AND TRADEMARK OFFICE

CERTIFICATE OF CORRECTION

PATENT NO. : 8,011,115 B2
APPLICATION NO. : 12/162503
DATED : September 6, 2011
INVENTOR(S) : Komulainen et al.

It is certified that error appears in the above-identified patent and that said Letters Patent is hereby corrected as shown below:

Column 10, line 35, “The device of claim 1” should be -- The device of claim 11 --.
Column 10, line 37, “The device of claim 1” should be -- The device of claim 11 --.

Signed and Sealed this
Fifth Day of June, 2012

David J. Kappos

David J. Kappos
*Director of the United States Patent and Trademark Office*